US010615499B2

(12) United States Patent
Lafleur et al.

(10) Patent No.: US 10,615,499 B2
(45) Date of Patent: Apr. 7, 2020

(54) DUAL ROLE ANTENNA ASSEMBLY

(71) Applicant: SKYWAVE MOBILE COMMUNICATIONS INC., Ottawa (CA)

(72) Inventors: Phil Lafleur, Ottawa (CA); David Roscoe, Ottawa (CA)

(73) Assignee: SKYWAVE MOBILE COMMUNICATIONS INC., Ottawa (CA)

( * ) Notice: Subject to any disclaimer, the term of this patent is extended or adjusted under 35 U.S.C. 154(b) by 265 days.

(21) Appl. No.: 14/596,288

(22) Filed: Jan. 14, 2015

(65) Prior Publication Data

US 2016/0204519 A1 Jul. 14, 2016

(51) Int. Cl.

| | |
|---|---|
| ***H01Q 5/50*** | (2015.01) |
| ***H01Q 1/38*** | (2006.01) |
| ***H01Q 9/04*** | (2006.01) |
| ***H01Q 3/24*** | (2006.01) |

(52) U.S. Cl.

CPC ..... *H01Q 5/50* (2015.01); *H01Q 1/38* (2013.01); *H01Q 3/24* (2013.01); *H01Q 9/0421* (2013.01); *H01Q 9/0428* (2013.01); *H01Q 9/0442* (2013.01)

(58) Field of Classification Search

CPC ..... H01Q 5/30; H01Q 5/307; H01Q 5/314; H01Q 5/50; H01Q 1/38; H01Q 3/24; H01Q 3/247; H01Q 9/04; H01Q 9/0421; H01Q 9/0428; H01Q 9/0442; H01Q 9/06; H01Q 9/16; H01Q 9/34; H01Q 9/36; H01Q 5/321; H01Q 5/328; H01Q 9/14; H01Q 21/28; H01Q 1/243; H01Q 9/42; H01Q 9/285; H01Q 21/30; G01S 19/01; G01S 19/03; H04B 7/0802; H04B 7/082; H04B 7/0825; H04B 7/0491; H04W 24/02

See application file for complete search history.

(56) References Cited

U.S. PATENT DOCUMENTS

| | | | |
|---|---|---|---|
| 5,303,396 | A | 4/1994 | Ooyagi et al. |
| 5,552,798 | A | 9/1996 | Dietrich et al. |
| 5,847,683 | A | 12/1998 | Wolfe et al. |

(Continued)

FOREIGN PATENT DOCUMENTS

| | | | |
|---|---|---|---|
| EP | 1011167 | A1 | 6/2000 |
| EP | 1341257 | A1 | 9/2003 |

(Continued)

OTHER PUBLICATIONS iPhone (Jun. 2007 release date) (Year: 2018).*

(Continued)

*Primary Examiner* — Olumide Ajibade Akonai

(74) *Attorney, Agent, or Firm* — Thomas Horstemeyer, LLP

(57) ABSTRACT

A dual role antenna assembly operable for use with GEO and LEO/MEO satellites has at least two curled inverted-F substantially omnidirectional antennas mounted on a ground plane. The antennas have asymmetrical gain patterns favoring certain sectors and are oriented such that the favored sectors of the different antenna face different directions. A controller selects the antenna for connection to an RF front-end in accordance with predetermined performance criteria.

19 Claims, 10 Drawing Sheets

(56) References Cited

U.S. PATENT DOCUMENTS 5,945,959 A 8/1999 Tanidokoro et al.
6,130,650 A * 10/2000 Curtis ..... H01Q 9/0421 343/828
6,229,487 B1 * 5/2001 Sadler ..... H01Q 1/243 343/700 MS
6,353,443 B1 * 3/2002 Ying ..... H01Q 1/243 343/700 MS
6,563,468 B2 5/2003 Hill et al.
6,662,028 B1 * 12/2003 Hayes ..... H01Q 1/243 343/908
6,693,598 B1 2/2004 Bishop et al.
6,759,990 B2 7/2004 Rossman
6,883,227 B2 4/2005 Lebaric et al.
6,980,154 B2 * 12/2005 Vance ..... H01Q 1/243 343/700 MS
7,466,276 B1 * 12/2008 Chen ..... H01Q 1/2258 343/700 MS
7,932,863 B2 * 4/2011 Pros ..... H01Q 1/243 343/700 MS
8,005,418 B2 8/2011 Walker et al.
8,305,270 B2 11/2012 Waters et al.
8,351,849 B2 1/2013 Ying
8,482,466 B2 7/2013 Thiam et al.
8,542,715 B2 9/2013 Feher
8,665,147 B2 3/2014 Anandakumar et al.
8,665,170 B2 3/2014 Bishop et al.
8,723,741 B2 5/2014 Shtrom et al.
8,736,490 B2 5/2014 Simic et al.
8,744,373 B2 6/2014 Pourseyed
8,830,910 B2 9/2014 Skarp
8,843,096 B2 9/2014 Becker et al.
8,879,509 B2 11/2014 Urquhart et al.
8,885,744 B2 11/2014 Kadous et al.
8,885,756 B1 11/2014 Wise
9,502,750 B2 * 11/2016 Yarga ..... H01Q 1/243
2004/0080457 A1 * 4/2004 Guo ..... H01Q 1/243 343/700 MS
2005/0113133 A1 * 5/2005 Li ..... H01Q 1/243 455/552.1
2006/0097919 A1 * 5/2006 Puckey ..... H01Q 1/243 343/700 MS
2007/0222697 A1 * 9/2007 Caimi ..... H01Q 1/243 343/861
2007/0224949 A1 * 9/2007 Morton ..... H01Q 3/247 455/101
2008/0055164 A1 * 3/2008 Zhang ..... H01Q 1/243 343/702
2008/0143610 A1 * 6/2008 Wang ..... H01Q 1/22 343/702
2009/0027260 A1 1/2009 Runyon et al.
2009/0058593 A1 * 3/2009 Breed ..... B60C 11/24 340/5.2
2009/0073063 A1 * 3/2009 Liu ..... G01R 29/10 343/703
2009/0085815 A1 4/2009 Jakab et al.
2010/0277376 A1 * 11/2010 Chakam ..... H01Q 1/3241 343/702
2011/0009078 A1 * 1/2011 Kawamura ..... G06K 19/07749 455/101
2013/0050056 A1 2/2013 Lee et al.
2013/0120194 A1 * 5/2013 Knadle ..... H01Q 9/285 343/700 MS
2013/0162477 A1 * 6/2013 Waters ..... G01S 19/36 342/372
2013/0249764 A1 * 9/2013 Amaya ..... H01Q 1/48 343/845
2014/0132457 A1 * 5/2014 Galeev ..... H01Q 5/35 343/702
2014/0253394 A1 9/2014 Nissinen et al.
2014/0292587 A1 * 10/2014 Yarga ..... H01Q 1/243 343/702
2015/0311594 A1 * 10/2015 Zhu ..... H01Q 13/10 343/702
2016/0073406 A1 * 3/2016 Aydin ..... H04W 24/02 370/331
2016/0204512 A1 * 7/2016 Ying ..... H01Q 9/04 343/893

FOREIGN PATENT DOCUMENTS

EP 1405439 B1 3/2006
EP 2284561 A1 2/2011

OTHER PUBLICATIONS iPhone 3GS Technical Specifications (iPhone 3G srelease date Jun. 2009) (Year: 2017).*
What is an Isatphone Pro (Isatphone Pro 2010-2014 production dates) (Year: 2018).*
Will your existing iPhone 6 case fit . . . (iPhone 6 release date Sep. 2014) (Year: 2018).*
Chattha et al., A Comprehensive Parametric Study of Planar Inverted F Antennas, Jan. 2012, Scientific Research, Wireless Engineering and Technology, 2012, 3, 1-11, pp. 1-11.*
Liu et al., The Inverted-F Antenna Height Effects on Bandwidth, 2005, IEEE, pp. 367-370.*
Tyco Electronics Corporation, Rochester, NY, Jun. 3, 2006, Antenna GPS Assembly 1513634-1, Drawing No. C-1513634, Revised Notes May 3, 2010.
Tyco Electronics Consumer Devices, 2011, Antenna Solutions, 1565-1585 MHz Single Band Antenna (GPS), Part No. 1513634-1, Catalog 4-1773459-2, Revised 03-11, www.antenna.te.com.

* cited by examiner

DUAL ROLE ANTENNA ASSEMBLY

FIELD OF THE INVENTION

This invention relates to the field of antenna, and more particularly to a dual role antenna assembly operable for use with use with geostationary earth orbit (GEO) and low earth orbit/medium earth orbit (LEO/MEO) satellite constellations, and to a method of controlling such an antenna.

BACKGROUND OF THE INVENTION

Designers of mobile satellite communication antenna systems are faced with a number of conflicting system requirements. The link budget benefits from higher gain, but an omnidirectional pattern is best from a system coverage perspective. The antennas should be low profile and yet have good low elevation angle performance. They should also be small and yet have sufficiently wide bandwidth.

Exploring these trade-offs typically leads to the selection of patch antenna technology if maintaining a low profile is critical, or helical antennas if profile is less important but low elevation angle performance is vital. Furthermore, maintaining low cost is critical for commercial applications.

While a patch antenna is typically low profile, there are a number of problems with the patch antenna, namely the low elevation angle performance is not good, in the case where the antenna and transceiver are integrated onto a single PCB, it takes up a large amount of space on the top side of the transceiver, forcing the electronics to the bottom side, limiting miniaturization. Moreover, the patch antenna requires a substantial ground plane further miniaturization and there is a difficult bandwidth/volume trade-off.

While a helical antenna typically has good low elevation angle performance, there are a number of problems with the helical antennas. They have a relatively high profile, typically a significant fraction of a wavelength in height, the radiation pattern is typically impaired by the ground plane/electronics PCB, and they take up a large amount of space on the top side of the transceiver.

Another substantially omnidirectional antenna is the curled inverted-F antenna (CIFA). This is essentially an inverted-F antenna with a curled-end. With the curled end and optimized placement and orientation in the corner of an optimally sized ground plane, reasonably good circular polarization performance can be achieved. One example of such an antenna is sold by TE Connectivity under part no. 1513634-1. This GPS antenna is about 6 mm in height and 16 mm in diameter.

While this antenna is compact and lends itself well to integration along with other components on the same PCB, it has a number of limitations, including narrow bandwidth (only about 22 MHz for the 1513634-1), and intrinsic radiation pattern issues, such as a tilted beam with non-uniform RHCP (Right Hand Circular Polarization) coverage, which would mitigate against using this kind of antenna for some GEO applications.

Diversity antenna systems are known, for example, as described in U.S. Pat. No. 8,305,270 to mitigate multipath fading, particularly deep fades. Known diversity systems do not improve system performance in situations where fading is not a factor.

SUMMARY OF THE INVENTION

Embodiments of the invention employ a diversity antenna system that uses a tilted radiation pattern to enhance low elevation angle gain for one higher priority satellite, while maintaining sufficient omnidirectionality to function well with the remaining satellites.

According to the present invention there is provided a dual role antenna assembly operable for use with GEO and LEO/MEO satellites, comprising a ground plane; at least two curled inverted-F substantially omnidirectional antennas mounted on the ground plane, said antennas having asymmetrical gain patterns favoring certain sectors, and said antennas being oriented such that the favored sectors of the different antenna face different directions, and an RF beam selection switch for selectively connecting said antenna to an RF front-end; and a controller controlling said RF beam selection switch to in accordance with predetermined performance criteria.

It will be understood that substantially omnidirectional in this context means that the antenna generally has all round coverage to receive (or transmit) signals from any direction outside of a small exclusion zone where reception (or transmission) is impaired. However, a radiation pattern is never completely uniform and in practice one direction has higher gain. Also, the gain pattern is generally tilted relative to the horizon, so that one sector will have better low elevation performance.

In one embodiment, for example for a dual GNSS/Satellite Communication (SATCOM) environment, the controller selects the antenna with the best RSSI (Received Signal Strength Indication) for the geostationary satellite communications system (GEO). A number of other system parameters could be used to control the switching. The performance could also be measured against some predetermined value.

The GNSS system then shares the selected antenna in a half duplex fashion. Because of frequency band proximity in the preferred embodiment, the same receive chain front-end is shared between GNSS and GEO. An alternative approach is to use the other antenna or one of the other antennas if there are more than two for the GNSS system.

Further embodiments of the invention thus provide two or more antenna elements in which GNSS and GEO front-ends, whether shared or separate are connected to share the same element or use different element according to predetermined selection criteria.

The bandwidth limitations of the CIFA element can be partly overcome by increasing the height the antenna, for example, by doubling the height to 12 mm. Thus, the height of the curled inverted-F antenna should be at least 12 mm for good bandwidth performance in GEO systems with typical manufacturing tolerances. However, in addition, multiple feed strips can be provided for the antenna to optimize its performance for multiple sub-bands. An RF switching module is provided in this case to switch between the feed strips according to the required sub-band depending on the particular frequency in use.

Further embodiments of the invention thus provide a multiband antenna consisting of two or more feed strips which enable switching to different frequency bands, creating a composite bandwidth that is larger than the instantaneous bandwidth and a multiple beam array (MBA) in which two or more substantially omnidirectional antenna elements are switched in such a way as to create a composite radiation pattern that has a more uniform overall radiation pattern with less pronounced coverage gaps than a single substantially omnidirectional element.

Unlike MBAs in the prior art, where the object is usually to create a directional beam, in accordance with the present invention the object of the MBA is to achieve omnidirectional coverage. The composite radiation pattern is achieved by connecting the RF front-end directly to the array element corresponding with the desired beam pattern. The superposition of individual element radiation patterns creates and an aggregate MBA radiation pattern. Keeping only one element active at a time is necessary to ensure that the MBA effective aperture area remains small, facilitating a more omnidirectional radiation pattern.

In one embodiment, two multiple beam array antennas are interchangeably used to communicate with two different satellites or groups of satellites (constellations), one being higher priority and the other being lower priority. For example, the higher priority system could be a geostationary L-band two-way satellite communication system with a single satellite and the lower priority system could be a medium earth orbit L-band constellation such as GPS, Galileo or GLONASS positioning systems.

To facilitate the design of the underlying antenna element, it is preferable to have the systems involved operate in nearby frequency bands. This enables simultaneous GEO/GNSS operation with the same RF front-end.

The product configuration in the preferred embodiment is a "GPS tracker" commonly used in a wide variety of telematics and logistics applications.

In accordance with another aspect the invention provides a method of controlling dual role antenna assembly operable for use with GEO and LEO/MEO satellites, comprising at least two curled inverted-F substantially omnidirectional antennas mounted on the ground plane, said antennas having asymmetrical gain patterns favoring certain sectors, and said antennas being oriented such that the favored sectors of the different antenna face different directions, said method comprising measuring a performance indication for each antenna; and selecting as a primary antenna the antenna with the best performance indication.

BRIEF DESCRIPTION OF THE DRAWINGS

The invention will now be described in more detail, by way of example only, with reference to the accompanying drawings, in which:

FIG. 4*a* shows a first elevation cut, FIG. 4*b* shows a second elevation cut, orthogonal to the cut of FIG. 4*a* and FIG. 4*c* shows an azimuth cut;

DETAILED DESCRIPTION OF THE INVENTION

Figure 1:
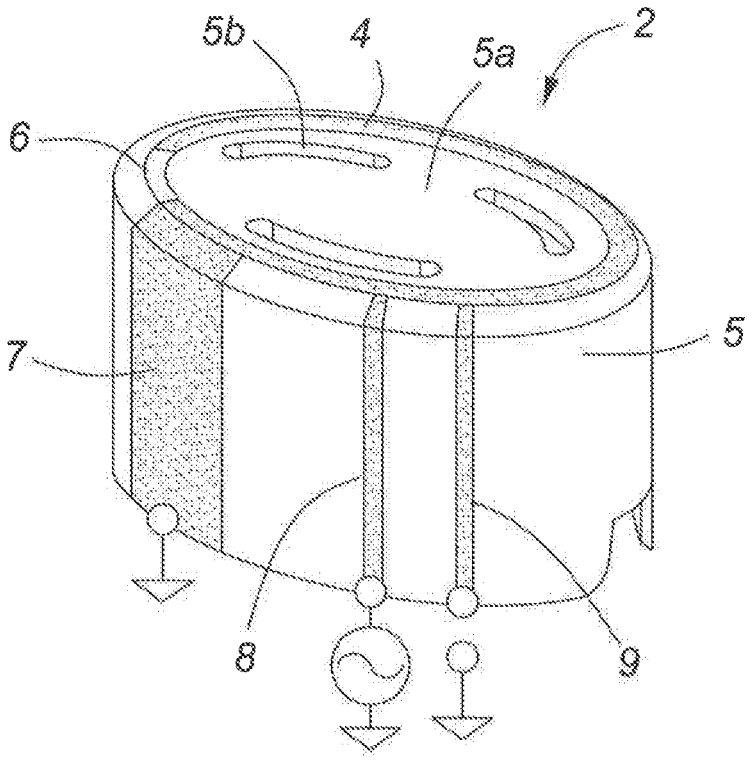
FIG. 1 is a perspective view of an antenna element.

The antenna element 2 shown in FIG. 1 is a curled inverted-F antenna comprising an interrupted curled metal strip 4 mounted or plated on the end of a hollow elliptical cylindrical dielectric form 5 with a closed top 5*a* having arcuate slits 5*b*.

While an elliptical shape illustrated has been found to give good performance, it will be understood that other shapes, such as circular cylindrical, may be employed. The elliptical shape has the added benefit of allowing a more space efficient use of the top side of a printed circuit board.

A small gap 6 is present between the ends of the interrupted circular metal strip 4. One ground strip 7 and two metal feed strips 8, 9, extend vertically from one end of the metal strip 4. Ground strip 7 is connected to the ground plane provided by the printed circuit board (PCB) 1. The other feed strips 8, 9 correspond to different frequency sub-bands.

Figure 2:
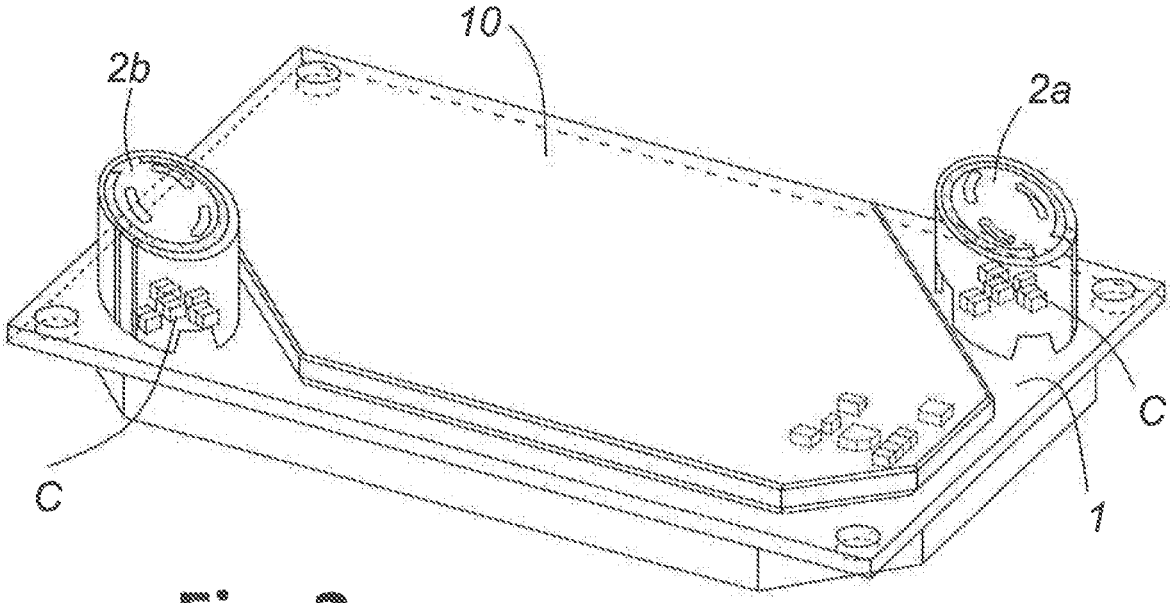
FIG. 2 is a perspective view of a two-antenna assembly mounted on a printed circuit board.

A two-element antenna assembly shown in FIG. 2 comprises a generally rectangular double sided printed circuit board 1, providing a ground plane, on which are mounted two antenna elements 2*a*, 2*b*, each as shown in FIG. 1. The antenna elements 2*a*, 2*b* are mounted at opposite corners of the printed circuit board 1, which also has a grounded cover 10 housing components mounted on the printed circuit board.

Figure 3:
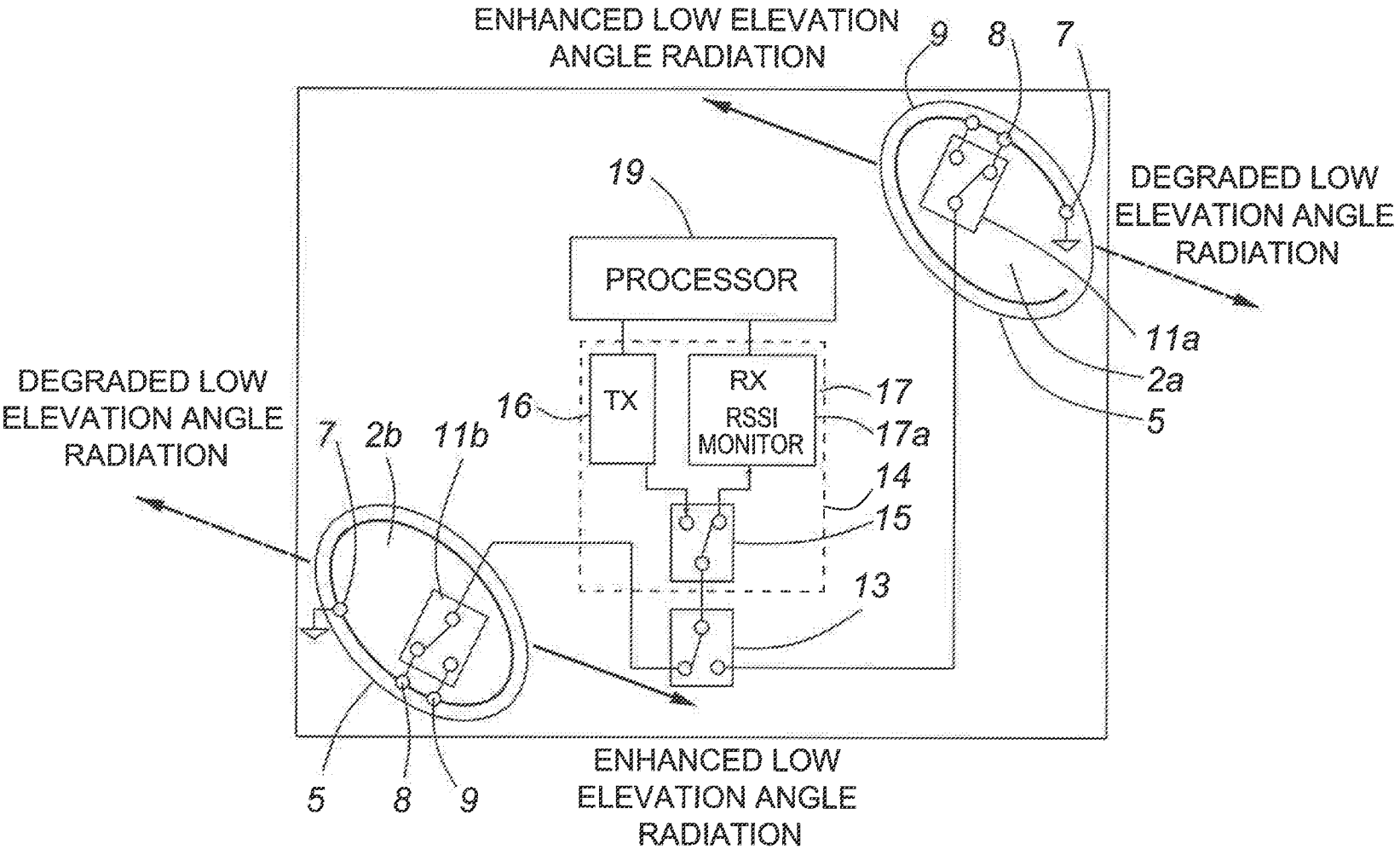
FIG. 3 is a plan view of the two-antenna assembly showing the switching components.

As shown in FIG. 3, the two feed strips 8, 9 of each antenna element 2*a*, 2*b* are connected to an RF switch 11*a*, 11*b* located as close as possible to the antenna element 2*a*, 2*b*, in this case inside the dielectric form 5, by traces on the printed circuit board 1. The RF switches 11*a*, 11*b* switch between different feed strips 8, 9 for different frequency sub-bands.

The RF switches 11*a*, 11*b* are connected by traces on the printed circuit board 1 to a beam-switching single-pole RF switch 13. The single-pole RF switch 13, which is connected to RF front-end 14, is used to switch between different antenna elements 2*a*, 2*b*. The RF front-end 14 may be a transceiver for receiving GNSS signals and transmitting and receiving communication signals. In this example, it comprises a transmit module 16, receive module 17, and RF switch 15 for switching between transmit and receive modules 16, 17. The receive module 17 also incorporates a signal strength monitor 17*a* for obtaining a received signal strength indication (RSSI).

The transmit module 16 is associated with the GEO satellites since it is used to transmit signals via the satellites to a remote ground station. The receive module 17 can be associated with either the GNNS system or the GEO communications system as commanded by a controller in the form of processor 19.

The RF switches 11*a*, 11*b*, 13, 15 and receive module 17 are controlled by processor 19, which also receives a received signal strength indication (RSSI) from RSSI monitor 17*a* in receive module 17.

As noted the GNSS positioning system, such as GPS, GLONASS, or Galileo, uses the satellites in a low or medium earth orbit, and which thus move relatively rapidly with respect to the receiver unlike the GEO communications satellites, which are in geostationary orbits.

The antenna elements 2*a*, 2*b* have an increased size relative to known curled inverted-F antennas. In the exemplary embodiment they are 12 mm in height and have major and minor axis radii of 11 mm and 7 mm, respectively. This gives them an increased bandwidth of 130 MHz centered near the GPS frequency band. While scaling volume increases bandwidth, an increase in height limits the applicability of this approach in wider band systems where low profile is required.

Figure 4A:
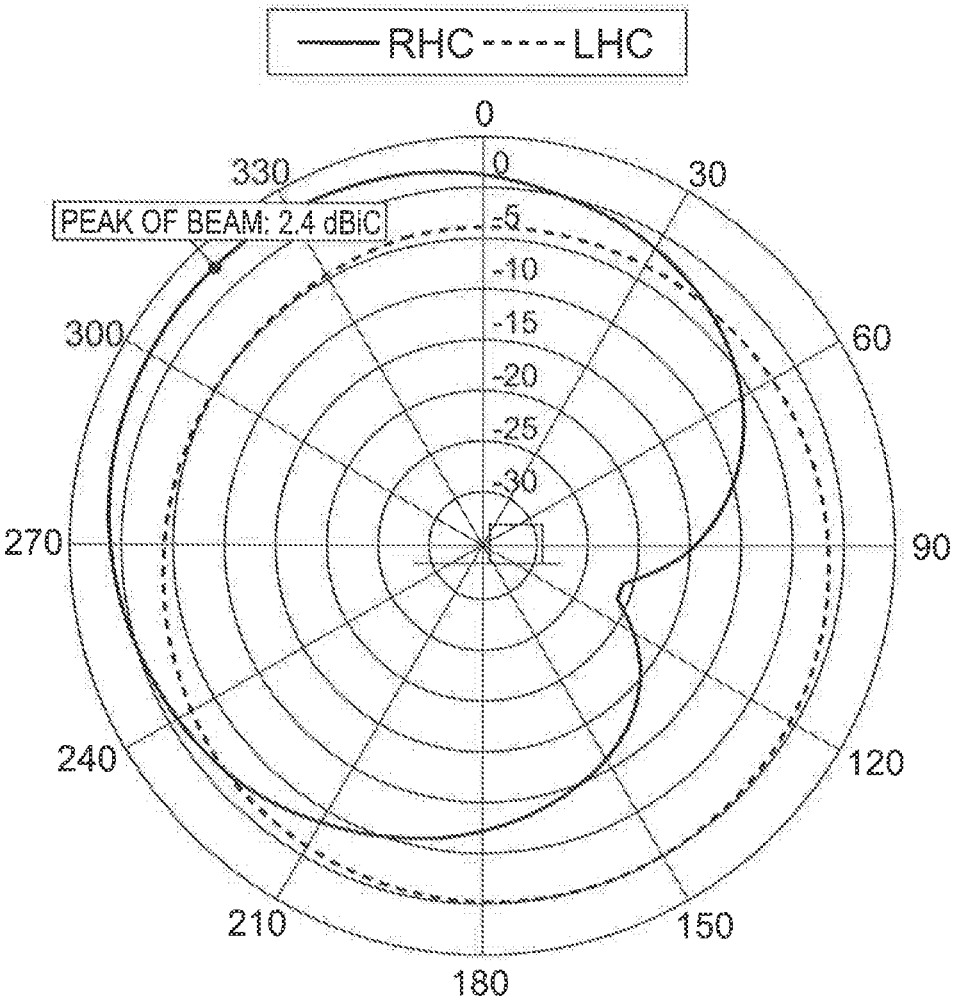
FIGS. 4*a*, 4*b*, and 4*c* are respectively sectional views showing the radiation patterns for right hand and left hand circular polarization for the single antenna shown in FIG. 1, where
Figure 4B:
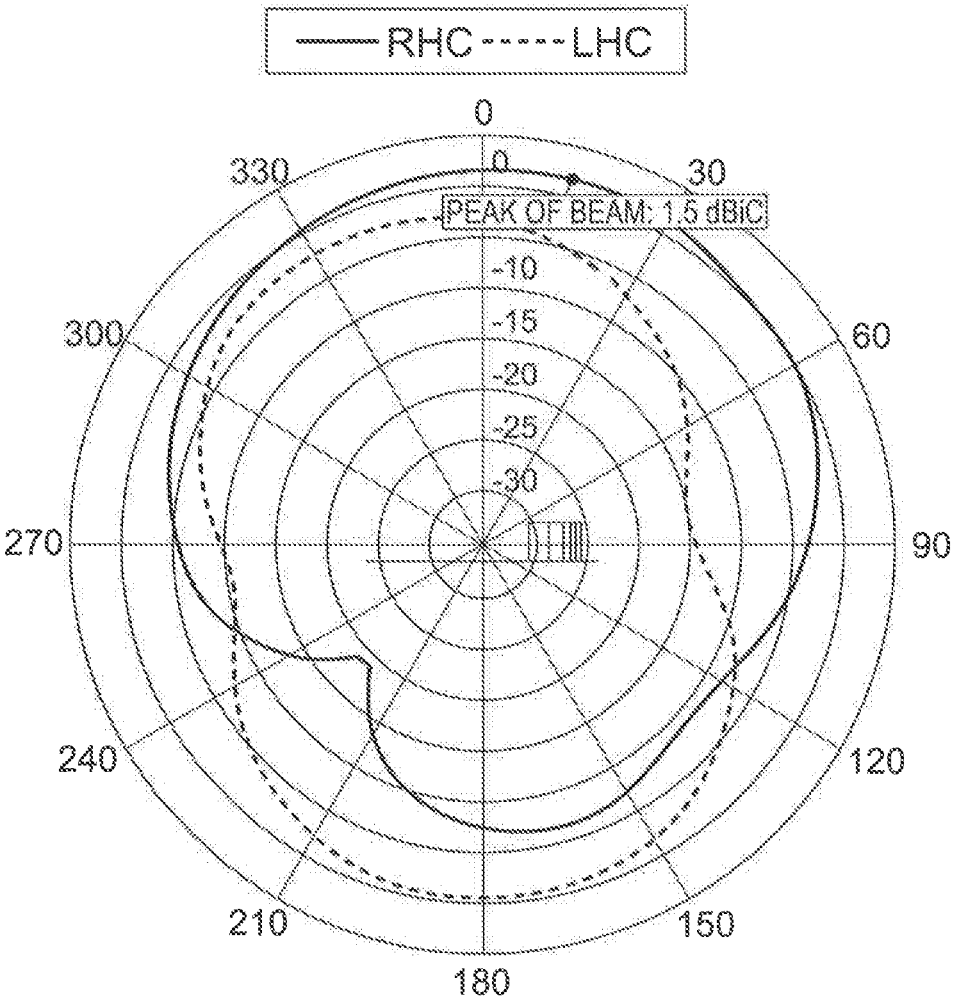
Figure 4C:
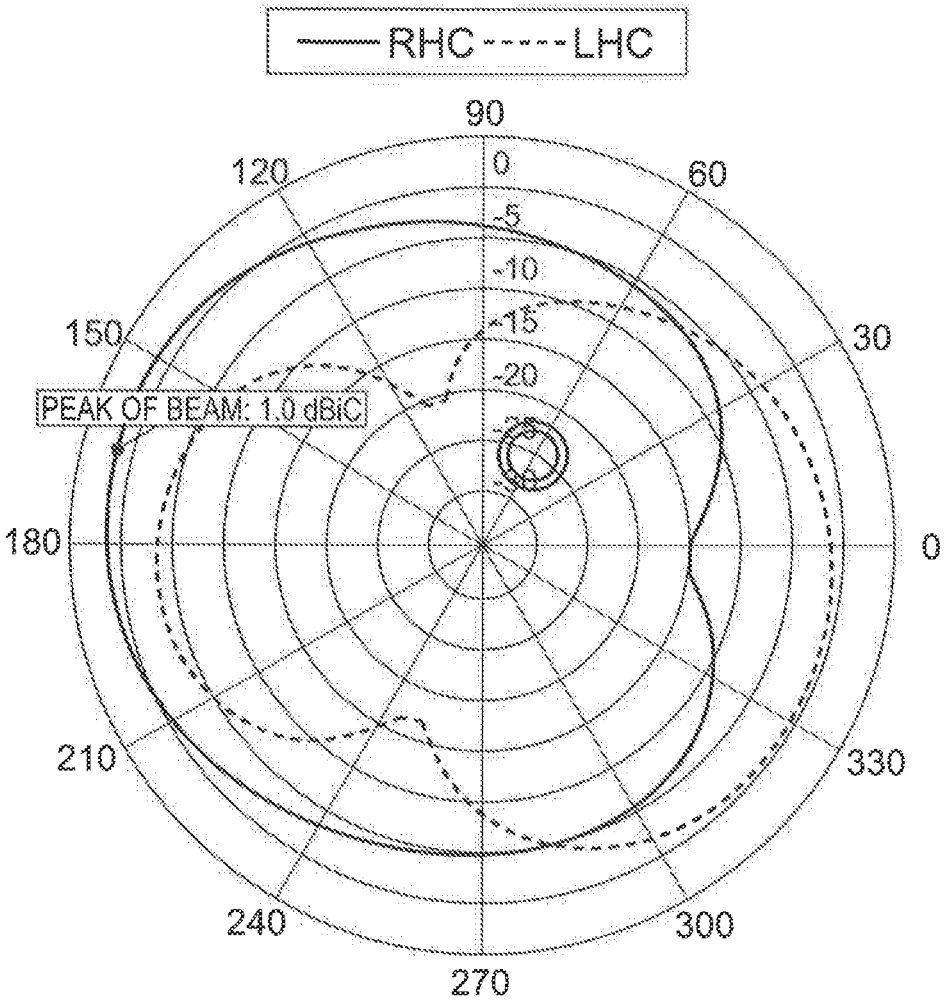

A single antenna 2 as shown in FIG. 1 mounted on a ground plane (PCB 1) has a radiation pattern as shown in FIGS. 4*a* to 4*c*, where FIG. 4*a* shows a first elevation cut, FIG. 4*b* shows a second elevation cut, orthogonal to the cut of FIG. 4*a*, and FIG. 4*c* shows an azimuth cut. The solid lines show the pattern for right hand circular polarization (RHCP) while the dashed lines show the pattern for left hand circular polarization (LHCP). In this preferred embodiment, RHCP is the desired polarization.

These patterns show that the gain pattern is substantially omnidirectional with slight bulge in one direction at low elevation angles (FIG. 4*a*) forming a beam or favored direction. Low elevation angle performance is the limiting factor in mobile satellite communication systems, making the azimuth cut of the radiation pattern (FIG. 4*c*) the focus of the present invention. The RHCP radiation pattern is tilted as shown in FIG. 4*a* with a beam peak typically at 165 degrees.

GEO system availability and reliability are more susceptible to radiation pattern tilt than GNSS constellations. While generally acceptable for GNSS constellations with multiple satellites in view at different look angles, the degraded RHCP gain at low elevation angles, such as zero degrees, does pose a problem for GEO systems where the only available satellite might be unreachable due to the low antenna gain.

Significantly, looking at the elevation cuts (FIGS. 4*a*, 4*b*), it will be seen that the low elevation performance is also directional. For example, looking at FIG. 4*a*, it will be seen that the gain is near 2 dBic at 300° but only −18 dBic at 120°, the corresponding position on the other side.

Figure 5:
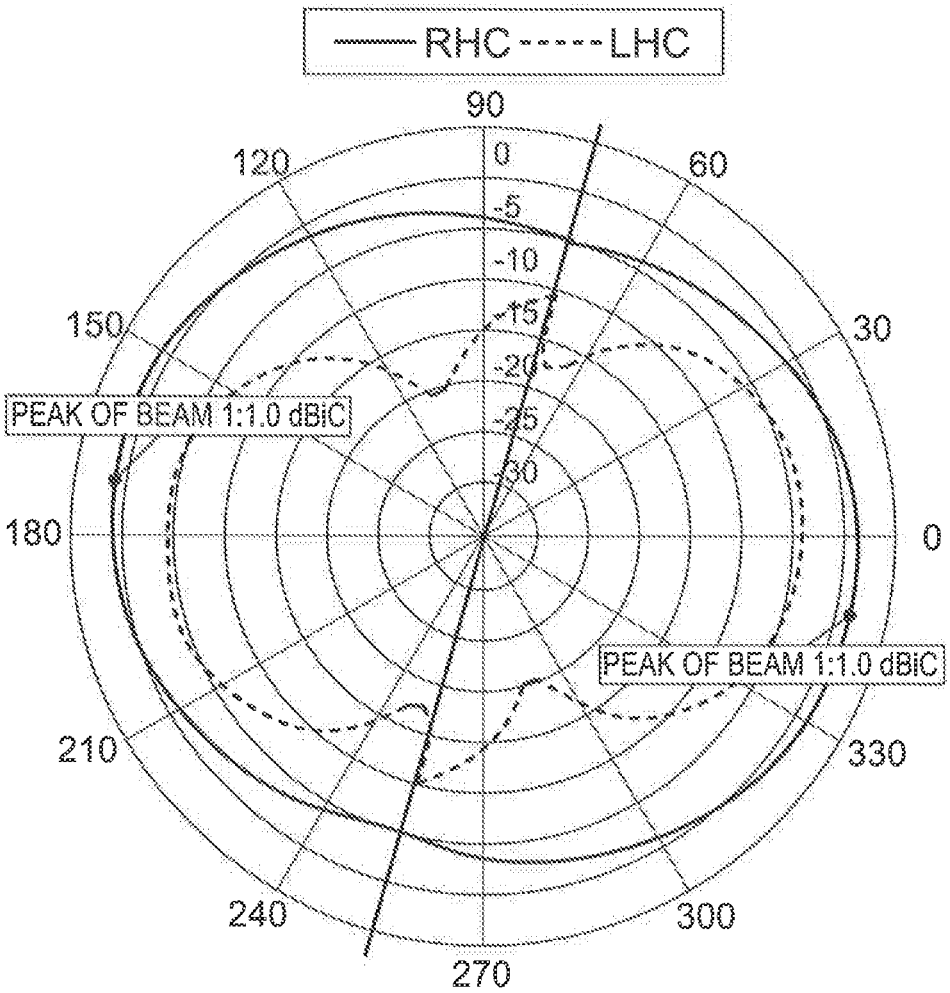
FIG. 5 is a sectional view showing the radiation pattern for the two-antenna assembly for right hand and left hand circular polarization in the horizontal plane.

In the embodiment shown in FIG. 3 the two diametrically opposed antenna array elements 2*a*, 2*b* are arranged at opposite corners of the printed circuit board 1 with ground plane with the favored directions for low elevation performance oriented in diametrically opposed directions. In this embodiment, antenna 2*a* has its favored direction for low elevation performance, i.e. optimum low elevation gain as shown in FIGS. 4*a*, 4*c* facing to the left and antenna element 2*b* has its favored direction oriented to the right as shown by the solid arrows. In this way, the highest gain sector of one element covers the lowest gain sector of the other as shown in FIG. 5.

The antennas 2*a*, 2*b* thus have substantially isotropic radiation patterns but whose radiation patterns are tilted to favor low elevation angle radiation in one sector. As shown in FIG. 3, these elements are arranged with 180 degree rotation relative to each other. As a result, the radiation from antenna 2*a* is strongest in the direction where antenna 2*b* is weakest and vice-versa. In this way, when the beam selection algorithm, described in more detail with reference to FIG. 9, run on processor 19 selects the best antenna, even in situations where multipath fading is not an issue, the system sees a net benefit to the link budget.

The reason that this is possible is that even though the radiation patterns are tilted to provide improved low elevation angle gain in one sector, the elements remain substantially omnidirectional. They are carefully designed to be sufficiently omnidirectional as to avoid significantly degraded system level MEO/LEO/GNSS performance, as measured in this case by position accuracy and 3-D fix availability. The composite antenna assembly offers good aggregate radiation performance, especially at low elevation angles. It should be noted however that having a tilted beam is of no benefit to the positioning system because the multiple satellites used in a given 3-D fix are distributed throughout the solid angle above and around the antenna.

Figure 6:
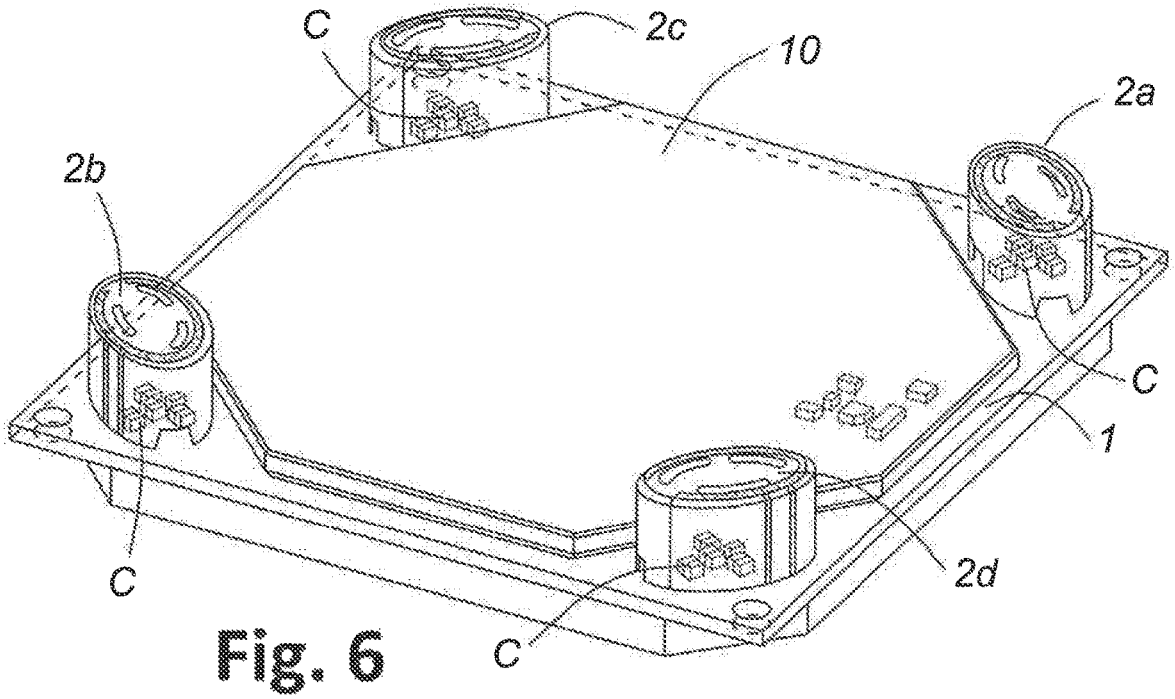
FIG. 6 is a perspective view of a four-antenna assembly mounted on a printed circuit board.
Figure 7:
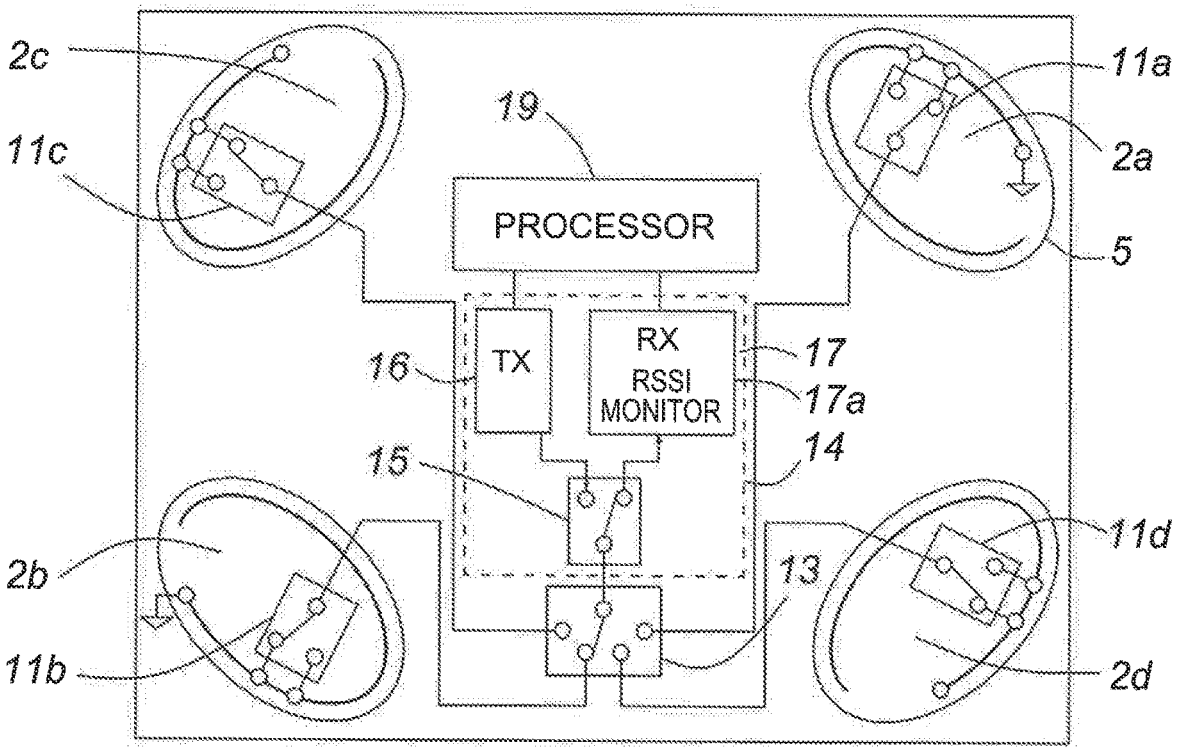
FIG. 7 is a plan view of the four-antenna showing the switching components.
Figure 8:
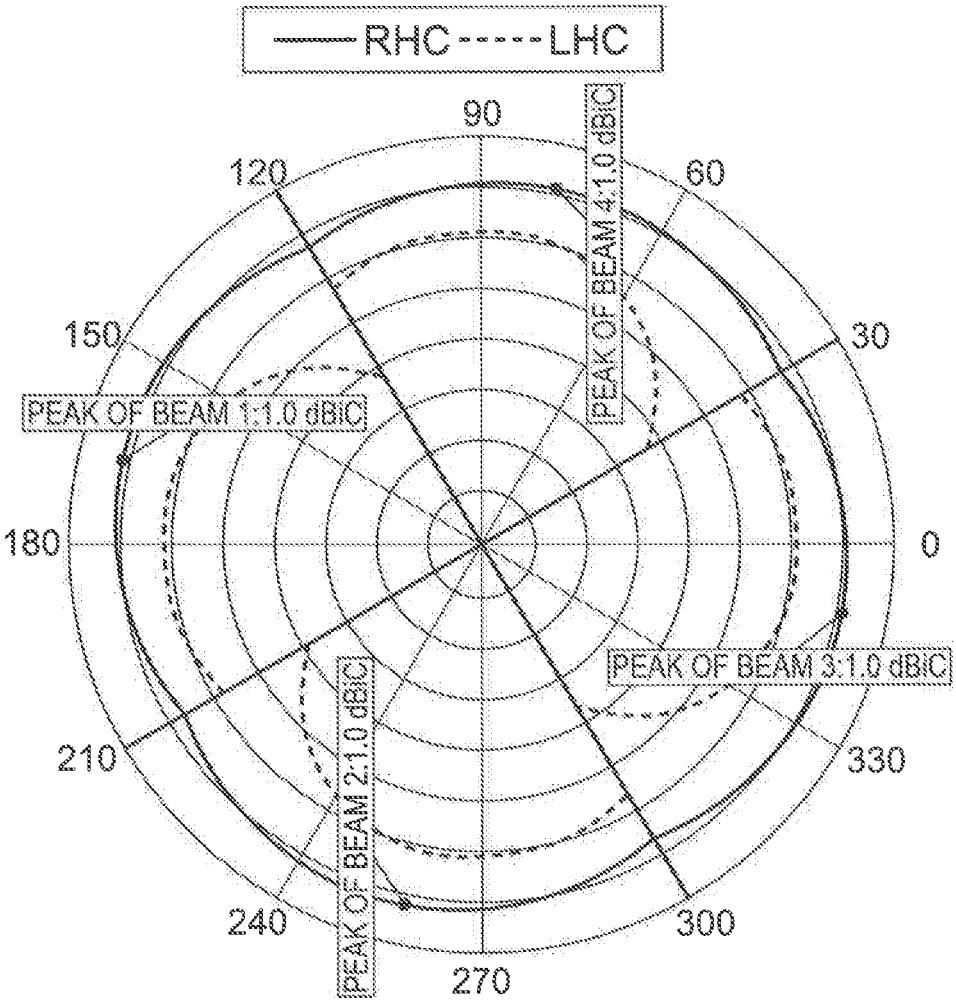
FIG. 8 is a sectional view showing the radiation pattern for the four-antenna assembly for right hand and left hand circular polarization in the horizontal plane.

In alternative embodiment, there may be additional antenna elements, for example, one antenna element 2*a*, 2*b*, 2*c*, 2*d* at each corner as shown in FIGS. 6 and 7. These can be oriented to provide optimum low elevation coverage. FIG. 8 shows a typically radiation pattern for a 4-antenna system with the patterns rotated 90 degrees for each antenna. It should be noted that adequate spacing between MBA elements must be maintained to prevent radiation pattern distortion at low elevation angles due to parasitic loading and blockage effects. As a result the minimum viable PCB size for the two-element configuration is smaller than the minimum viable configuration for the four-element configuration. Two-element configurations tend to be rectangular and four-element configurations tend to be square like.

In the case of a two-element array, switch 15 is a TX/RX SPDT switch, switch 13 is a beam selection SPDT switch, and switches 11*a*, 11*b* are frequency band selection switches. In the case of a four-element array, the SPDT beam selection switch 13 is a SP4T beam selection switch. As noted all the RF switches are controlled by the processor 19, and the beam selection switch control depends on readings from the RSSI measurement module shown here integrated in the receiver 17.

It is important that the frequency band selection switches 11*a*, 11*b*, 11*c*, 11*d* be located very close to the CIFA feed points. In a dual-band configuration, the unused feed strip is loading the antenna, acting like an open-circuit stub and is an in integral part of the matching network. Having an excessively long trace to the port of the reflective SPDT switch would reduce the usable bandwidth of the antenna. In a triple or quad-band configuration, all unused feed strips act in a similar way and have to be carefully taken into account. In the embodiments presented here, the beam selection switches are located inside the hallow CIFA element with ventilation added to facilitate simultaneous reflow soldering of the CIFA and the switches located inside. Lastly, it should be noted that the RF switches can be located either inside or outside of the RF shields as they see the substantially the same signal as the antenna itself.

Diversity antenna control algorithms that can be used are well known in the art. One example is provided by U.S. Pat. No. 8,305,270, the contents of which are herein incorporated by reference. This uses constellation metrics and signal quality for antenna selection.

Unlike the system described in U.S. Pat. No. 8,305,280 and similar prior art, embodiments of the present invention use the concept of system priority in its beam selection algorithm. Because of the nature of GNSS systems, their satellites are well distributed across the solid angle captured by the antenna. This makes GNSS systems resistant to the loss of some fraction of the captured solid angle. In contrast, because GEO systems typically rely on a single satellite, they are much more susceptible to degraded gain in a single line of sight. Embodiments of the present invention map this resilience/susceptibility to priority level to the antenna selection algorithm.

In the preferred embodiment, priority is given to the GEO system, because it is a single satellite system that can benefit from a tilted beam and because of its more constrained link budget.

Figure 9:
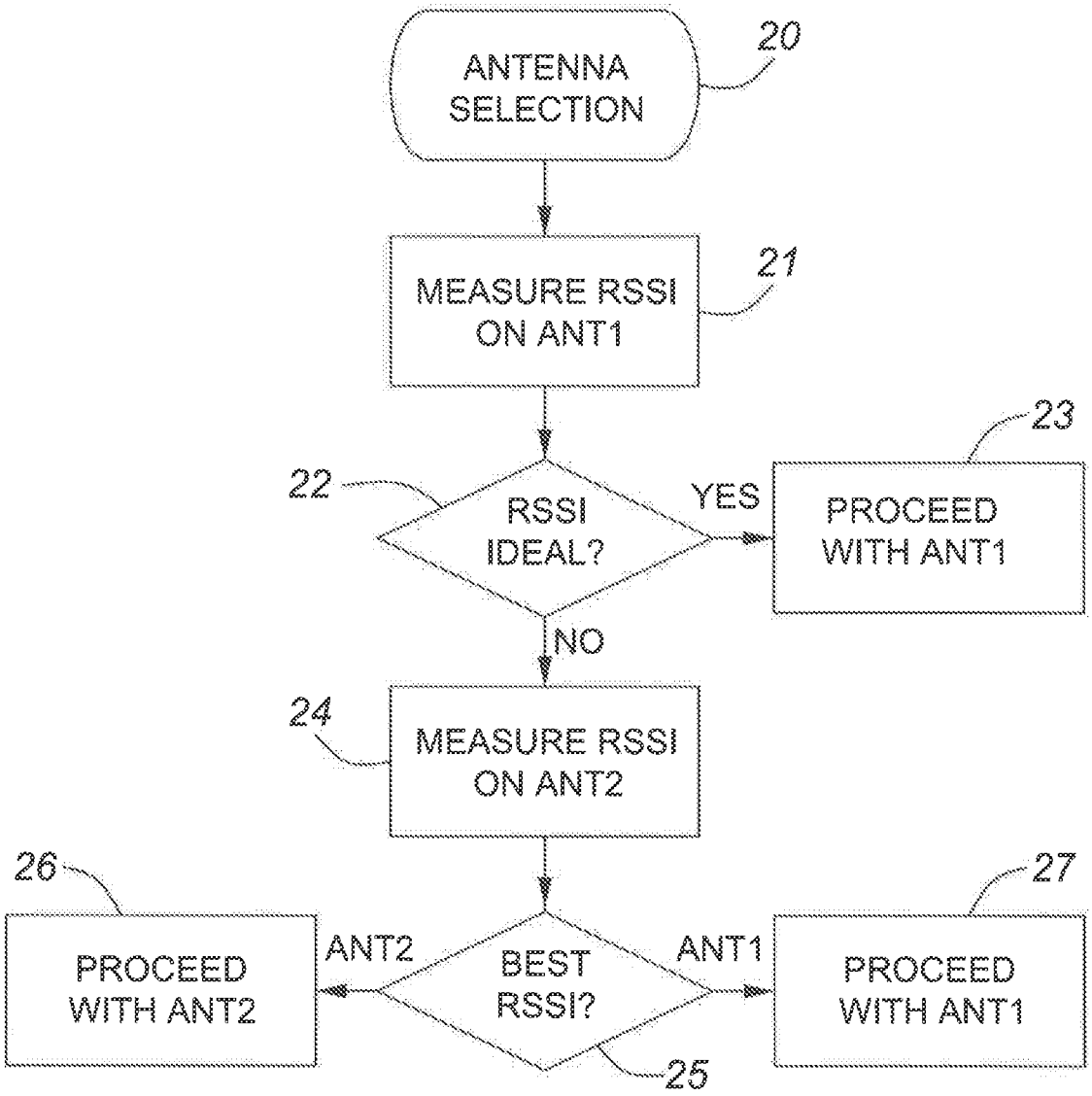
FIG. 9 shows an algorithm for determining the antenna selection.

The antenna selection algorithm carried out in processor 19 is shown in FIG. 9. Upon receiving a starting stimulus at 20, for a 2-antenna system as shown in FIG. 2, the process starts at step 21 by measuring the received signal strength (RSSI) on antenna 2*a* (ANT1). If the RSSI meets a predetermined criterion at step 22, in this case considered ideal, the processor 18 commands the switch 13 to connect antenna 2*a* to the RF front-end module 14 for satellite communications at step 24.

If at step 22 the RSSI does not meet the predetermined criterion, the processor 18 commands the module 14 to measure the RSSI on antenna 3 (ANT2) at step 24.

At step 25, the processor determines which RSSI is best and connects the GEO module 14 to the corresponding antenna at steps 26, 27.

The process can be repeated at regular intervals or alternatively triggered in response to signal degradation, for example, due to the motion of a vehicle on which the antenna assembly is mounted.

In this embodiment, the GNSS system shares the antenna that was selected for the GEO system in a half-duplex fashion. The GEO system shares the receiver front-end with the GNSS system, but when the GEO system transmits, the receiver front-end is disconnected. In this embodiment, transmissions generally scheduled not to conflict with GPS and are short in duration to reduce possible impact on GPS performance in cases where schedule accommodation is not possible. An alternative approach to deal with longer transmissions would be to have the GNSS system use the opposite antenna from the GEO system, to avoid disconnecting the GNSS system during transmit.

Figure 10:
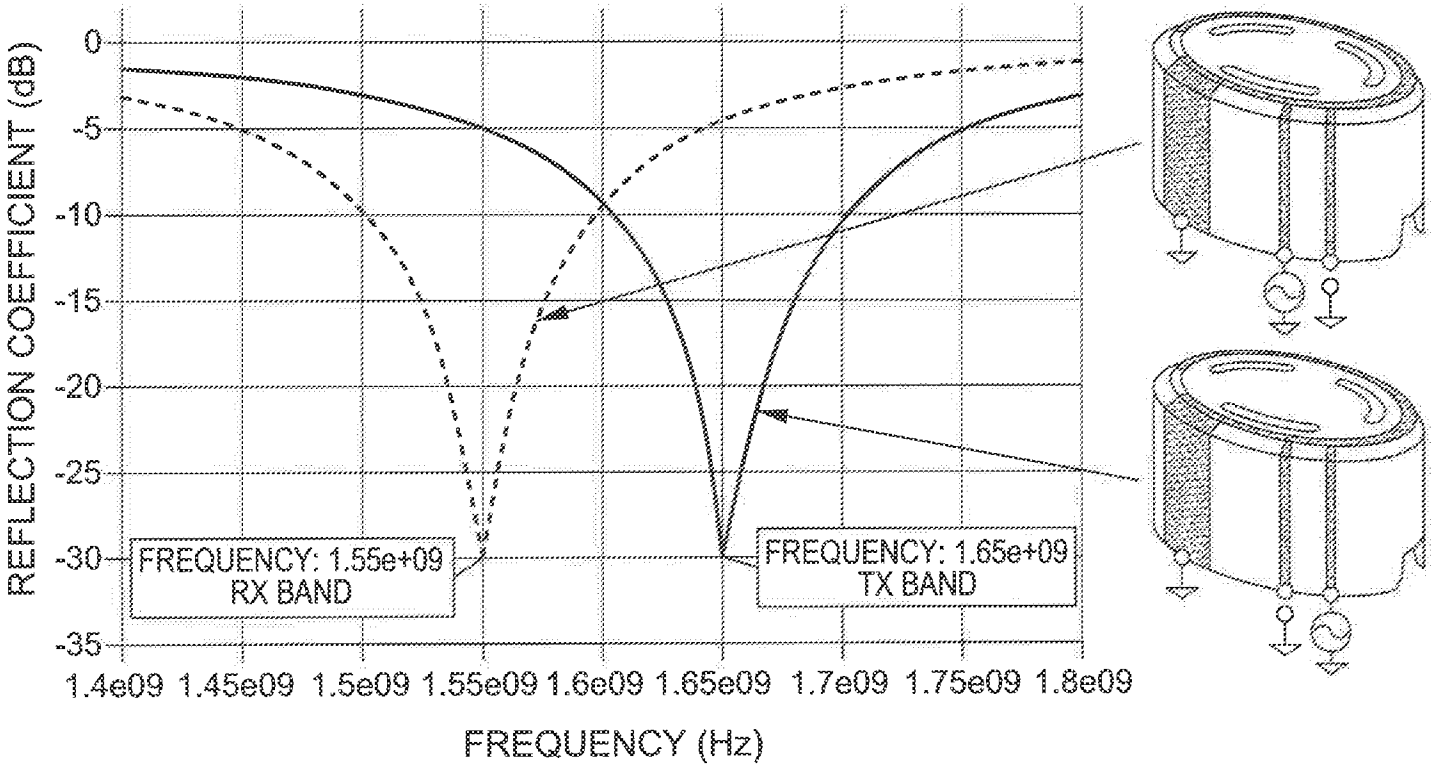
FIG. 10 shows the frequency response for a tunable antenna with two different feed points.

Another important consideration is frequency and bandwidth. By providing two feed strips 8, 9 the antenna can be optimized over two sub-bands. FIG. 10 shows the frequency response for the different feed strips. The peak (minimum reflectance) shifts for the different cases where the antenna is fed through the different feed strips.

In a preferred embodiment, the higher priority GEO system operates from 1518 MHz to 1675 MHz, which requires almost 10% bandwidth. By making the antenna tunable, it can be stepped across the frequency band to cover the frequency band, despite its limited instantaneous bandwidth.

It will thus be seen that embodiments of the invention provide a system that makes use of both GEO (such as Inmarsat) satellites and non-GEO GNSS satellite constellations (such as GPS, Galileo, GLONASS) and employs a multi-element, multi-beam antenna array with elements that have substantially isotropic radiation patterns but whose patterns are tilted to favor radiation in directions opposite to each other.

A beam selection algorithm selects the optimal antenna based on signal strength, wherein priority is given to the GEO system. The systems results in the low elevation antenna gain of the array over 360 degrees of azimuth exceeding the gain that would be achieved by a single element, while maintaining sufficient omnidirectionality to avoid degraded non-GEO system performance.

The invention claimed is:

1. A dual-role antenna assembly operable for use with both geostationary earth orbit (GEO) and low earth orbit/medium earth orbit (LEO/MEO) satellites, the dual-role antenna assembly comprising:

a ground plane;

a first curled inverted-F substantially omnidirectional antenna mounted to the ground plane, the first curled inverted-F substantially omnidirectional antenna having a first asymmetrical gain pattern with a first higher gain sector in a first direction, the first curled inverted-F substantially omnidirectional antenna being adapted for communicating with either of GEO satellites or LEO/MEO satellites;

a second curled inverted-F substantially omnidirectional antenna mounted to the ground plane in a position diametrically opposed to the first curled inverted-F substantially omnidirectional antenna, the second curled inverted-F substantially omnidirectional antenna having a second asymmetrical gain pattern with a second higher gain sector in a second direction, the second curled inverted-F substantially omnidirectional antenna being adapted for communicating with either of GEO satellites or LEO/MEO satellites;

an RF beam selection switch for selectively connecting the first curled inverted-F substantially omnidirectional antenna and the second curled inverted-F substantially omnidirectional antenna to an RF front-end; and a controller programmed to select either the first or second curled inverted-F substantially omnidirectional antenna and use the selected curled inverted-F substantially omnidirectional antenna for GEO satellites based at least in part on a predetermined criteria, wherein the controller is programmed to prioritize GEO satellite communications over LEO/MEO satellite communications by scheduling a LEO/MEO satellite communication to not transmit on the selected curled inverted-F substantially omnidirectional antenna while a GEO satellite communication transmits on the selected curled inverted-F substantially omnidirectional antenna, wherein at least one of said first and second curled inverted-F substantially omnidirectional antenna comprises two feed strips and a ground strip, and wherein each feed strip corresponds to a different frequency sub-band.

2. A dual-role antenna assembly as claimed in claim 1, wherein at least one of the curled inverted-F substantially omnidirectional antennas is mounted on an elliptical dielectric form.

3. A dual-role antenna assembly as claimed in claim 1, wherein the first and second asymmetrical gain patterns are tilted in relation to the ground plane.

4. A dual-role antenna assembly as claimed in claim 1, wherein the controller is programmed to select either the first curled inverted-F substantially omnidirectional antenna or the second curled inverted-F substantially omnidirectional antenna and share the selected curled inverted-F substantially omnidirectional antenna between at least two frequencies associated with at least two corresponding satellites in a half-duplex manner.

5. A dual-role antenna assembly as claimed in claim 4, wherein the controller is programmed to give priority to frequencies between 1518 Mhz and 1675 Mhz.

6. A dual-role antenna assembly as claimed in claim 1, wherein the controller is programmed to use a non-selected curled inverted-F substantially omnidirectional antenna for LEO/MEO satellites.

7. A dual-role antenna assembly as claimed in claim 1, further comprising a received signal strength monitor configured to provide a received signal strength indication, and wherein the predetermined criteria comprise the received signal strength indication.

8. A dual-role antenna assembly as claimed in claim 7, wherein the received signal strength indication is based on signals received from a GEO satellite.

9. A dual-role antenna assembly as claimed in claim 1, wherein said first and second curled inverted-F substantially omnidirectional antennas are tunable between frequency sub-bands, and each of the curled inverted-F substantially omnidirectional antennas further comprises a frequency switch operative to switch between the frequency sub-bands.

10. A dual-role antenna assembly as claimed in claim 9, wherein each said frequency switch is controlled by said controller.

11. A dual-role antenna assembly as claimed in claim 9, wherein said curled inverted-F substantially omnidirectional antennas have multiple feed points corresponding to respective ones of the frequency sub-bands.

12. A dual-role antenna assembly as claimed in claim 9, wherein the ground plane lies on a printed circuit board, and each said frequency switch is mounted on the printed circuit board in proximity to the first and second curled inverted-F substantially omnidirectional antennas.

13. A dual-role antenna assembly as claimed in claim 9, wherein said frequency switch of each said antenna is mounted inside a dielectric form forming part of each said curled inverted-F substantially omnidirectional antenna.

14. A dual-role antenna assembly as claimed in claim 1, wherein the first and second asymmetrical gain patterns are tilted in relation to the ground plane with Right Hand Circular Polarization coverage.

15. A dual-role antenna assembly as claimed in claim 1, wherein a height of at least one of the curled inverted-F substantially omnidirectional antennas is at least 12 mm.

16. An antenna comprising:

a dielectric form of elliptical cross section; and conductive strips peripherally mounted on said dielectric form to provide a curled inverted-F substantially omnidirectional antenna, said curled inverted-F substantially omnidirectional antenna having an asymmetrical gain pattern with a higher gain pattern in one direction, wherein said conductive strips comprise two feed strips and a ground strip, and wherein each feed strip corresponds to a different frequency sub-band.

17. An antenna as claimed in claim 16, wherein said dielectric form is hollow.

18. An antenna as claimed in claim 16, wherein said dielectric form has major and minor axis radii of 11 mm and 7 mm, respectively.

19. An antenna as claimed in claim 16, wherein said dielectric form has a height of 12 mm.

* * * * *